US010690016B2

(12) United States Patent
Roberts et al.

(10) Patent No.: US 10,690,016 B2
(45) Date of Patent: Jun. 23, 2020

(54) ENGINE VALVE LIFTER HAVING ANTI-ROTATION PLUG

(71) Applicant: Eaton Intelligent Power Limited, Dublin (IE)

(72) Inventors: Leighton Roberts, Kalamazoo, MI (US); Kevin Matson, Marshall, MI (US); Douglas Wright, Nottawa, MI (US); James E. McCarthy, Jr., Kalamazoo, MI (US); Matthew Vance, Kalamazoo, MI (US); Otto Schultheis, Albion, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/104,663

(22) Filed: Aug. 17, 2018

(65) Prior Publication Data

US 2018/0363513 A1 Dec. 20, 2018

Related U.S. Application Data

(63) Continuation-in-part of application No. PCT/US2017/018247, filed on Feb. 17, 2017.
(Continued)

(51) Int. Cl.
*F01L 1/14* (2006.01)
*F01L 1/18* (2006.01)
(Continued)

(52) U.S. Cl.
CPC ..... *F01L 1/146* (2013.01); *F01L 1/143* (2013.01); *F01L 1/181* (2013.01); *F01L 1/185* (2013.01);
(Continued)

(58) Field of Classification Search
CPC ... F01L 1/146; F01L 1/24; F01L 1/181; F01L 1/2405; F01L 1/185; F01L 1/25;
(Continued)

(56) References Cited

U.S. PATENT DOCUMENTS 6,953,016 B2 * 10/2005 Karbstein ..... F01L 1/146 123/90.48
8,616,168 B2 * 12/2013 Copper ..... F01L 1/143 123/90.48
(Continued)

FOREIGN PATENT DOCUMENTS

WO 2015106051 A1 7/2015

OTHER PUBLICATIONS

PCT International Search Report and Written Opinion dated May 29, 2017 for PCT International Application No. PCT/US2017/018247, 12 pages.

*Primary Examiner* — Patrick Hamo
*Assistant Examiner* — Wesley G Harris
(74) *Attorney, Agent, or Firm* — RMCK Law Group PLC

(57) ABSTRACT

An engine roller lifter for use in a leak-valvetrain of an internal combustion engine includes a body, a roller and an anti-rotation plug. The body includes an outer peripheral surface configured for sliding movement in a bore provided in the engine. The bore is supplied oil by an oil passage communicating therewith. The body defines an opening. The roller bearing is rotatably mounted to the body and is configured for rolling contact with an engine camshaft. The anti-rotation plug is received at the opening and has a plug body including an anti-rotation protrusion that extends radially beyond an outer peripheral surface of the plug body. The anti-rotation plug can be staked into the opening of the body.

17 Claims, 17 Drawing Sheets

Related U.S. Application Data

(60) Provisional application No. 62/459,787, filed on Feb. 16, 2017, provisional application No. 62/405,020, filed on Oct. 6, 2016, provisional application No. 62/336,625, filed on May 14, 2016, provisional application No. 62/306,342, filed on Mar. 10, 2016, provisional application No. 62/304,686, filed on Mar. 7, 2016, provisional application No. 62/298,233, filed on Feb. 22, 2016, provisional application No. 62/297,545, filed on Feb. 19, 2016, provisional application No. 62/719,003, filed on Aug. 16, 2018, provisional application No. 62/611,196, filed on Dec. 28, 2017.

(51) Int. Cl.

| | |
|---|---|
| ***F01L 1/24*** | (2006.01) |
| ***F01L 1/25*** | (2006.01) |
| *F01L 1/245* | (2006.01) |
| *F01L 1/047* | (2006.01) |

(52) U.S. Cl.

CPC ..... *F01L 1/24* (2013.01); *F01L 1/2405* (2013.01); *F01L 1/25* (2013.01); *F01L 2001/054* (2013.01); *F01L 2001/2427* (2013.01); *F01L 2001/2433* (2013.01); *F01L 2001/256* (2013.01); *F01L 2101/02* (2013.01); *F01L 2105/02* (2013.01); *F01L 2107/00* (2013.01)

(58) Field of Classification Search

CPC . F01L 1/143; F01L 2101/02; F01L 2001/054; F01L 2001/256; F01L 2107/00; F01L 2001/2433; F01L 2105/02; F01L 2001/2427; F01L 2105/00; F01L 1/14

USPC ..... 123/90.5, 90.48

See application file for complete search history.

(56) References Cited

U.S. PATENT DOCUMENTS

| | | | | |
|---|---|---|---|---|
| 2006/0016406 | A1* | 1/2006 | Geyer | F01L 1/14 123/90.5 |
| 2006/0107917 | A1 | 5/2006 | Backert et al. | |
| 2010/0294219 | A1 | 11/2010 | Prokop | |
| 2011/0259142 | A1 | 10/2011 | Copper et al. | |
| 2012/0152187 | A1* | 6/2012 | Cornett | F01L 1/14 123/90.5 |
| 2017/0074125 | A1* | 3/2017 | Nielsen | F01L 1/14 |
| 2017/0306810 | A1* | 10/2017 | Nielsen | F01L 1/146 |

* cited by examiner

| Dry Lash | Reserve Ratio |
|---|---|
| 1 | 7.3 |
| 1.5 | 4.9 |
| 2 | 3.7 |
| 3 | 2.4 |
| 4 | 1.8 |
| 4.5 | 1.6 |

ENGINE VALVE LIFTER HAVING ANTI-ROTATION PLUG

CROSS-REFERENCE TO RELATED APPLICATION

This application is a continuation-in-part of International Application No. PCT/US2017/018247 filed on Feb. 17, 2017, which claims the benefit of U.S. Provisional Application No. 62/297,545 filed on Feb. 19, 2016, U.S. Provisional Application No. 62/298,233 filed on Feb. 22, 2016, U.S. Provisional Application No. 62/304,686 filed on Mar. 7, 2016, U.S. Provisional Application No. 62/306,342 filed on Mar. 10, 2016, U.S. Provisional Application No. 62/336,625 filed on May 14, 2016, U.S. Provisional Application No. 62/405,020 filed on Oct. 6, 2016, and U.S. Provisional Application No. 62/459,787 filed on Feb. 16, 2017. This application claims the benefit of U.S. Provisional Application No. 62/611,196 filed on Dec. 28, 2017 and U.S. Provisional Application No. 62/719,003 filed on Aug. 16, 2018. The entire disclosure of each of the above applications are incorporated herein by reference.

FIELD

The present disclosure relates generally to hydraulic lash adjusting tappets of the type having a roller follower for contacting a cam shaft in an internal combustion engine valvetrain.

BACKGROUND

Roller lifters can be used in an engine valvetrain to reduce friction and as a result provide increased fuel economy. In other advantages, a roller lifter can open a valve quicker and for a longer period of time than a flat tappet lifter. In this regard, airflow can be attained quicker and longer increasing the ability to create power. In some applications it is desirable to keep the roller lifter from rotating around its longitudinal axis during operation.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

BRIEF DESCRIPTION OF THE DRAWINGS

The present disclosure will become more fully understood from the detailed description and the accompanying drawings, wherein.

DETAILED DESCRIPTION

Figure 1:
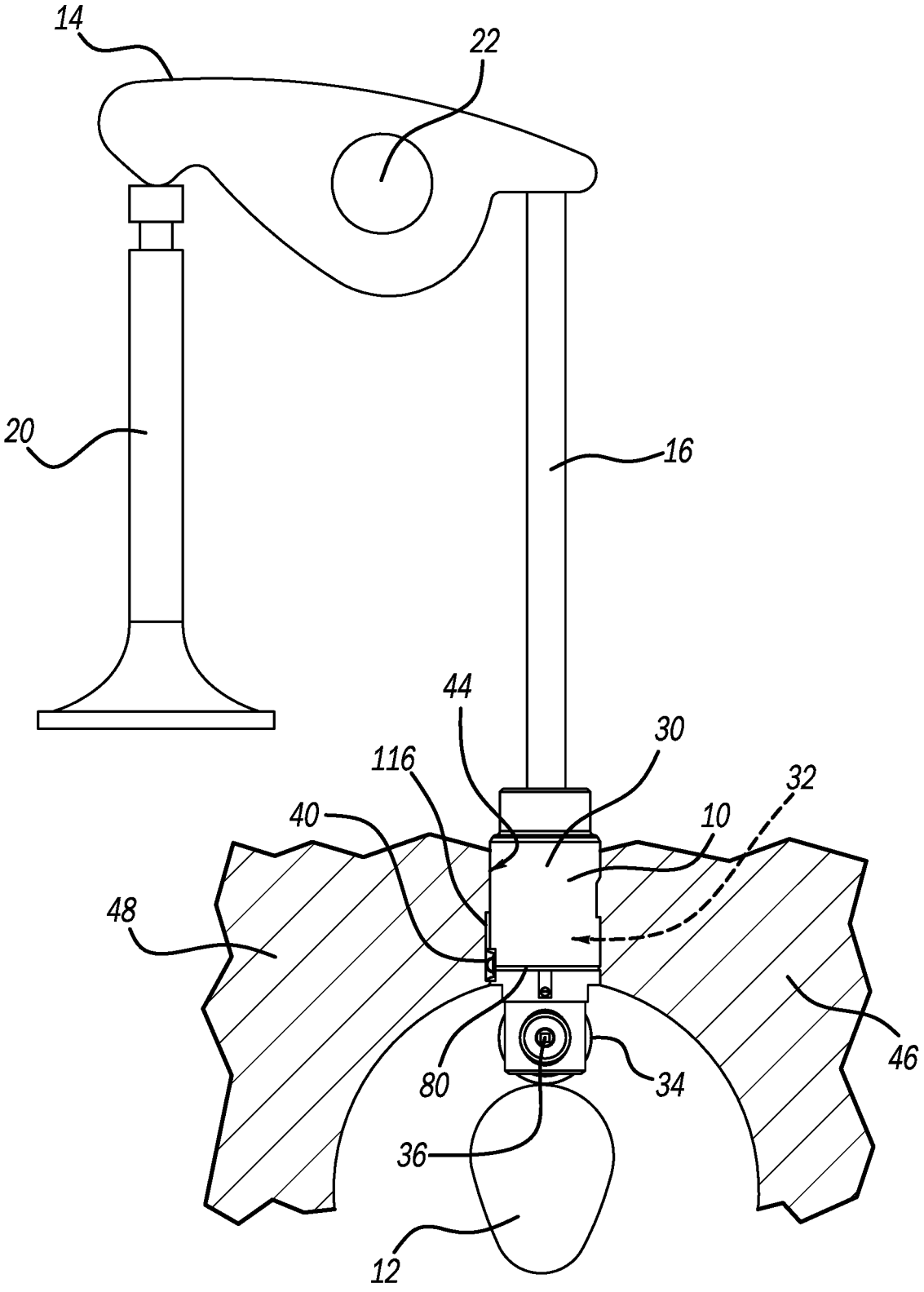
FIG. 1 is a roller lifter constructed in accordance to one example of the present disclosure and shown in an exemplary Type V valvetrain arrangement and shown with an anti-rotation plug according to one example of the present disclosure.
Figure 2:
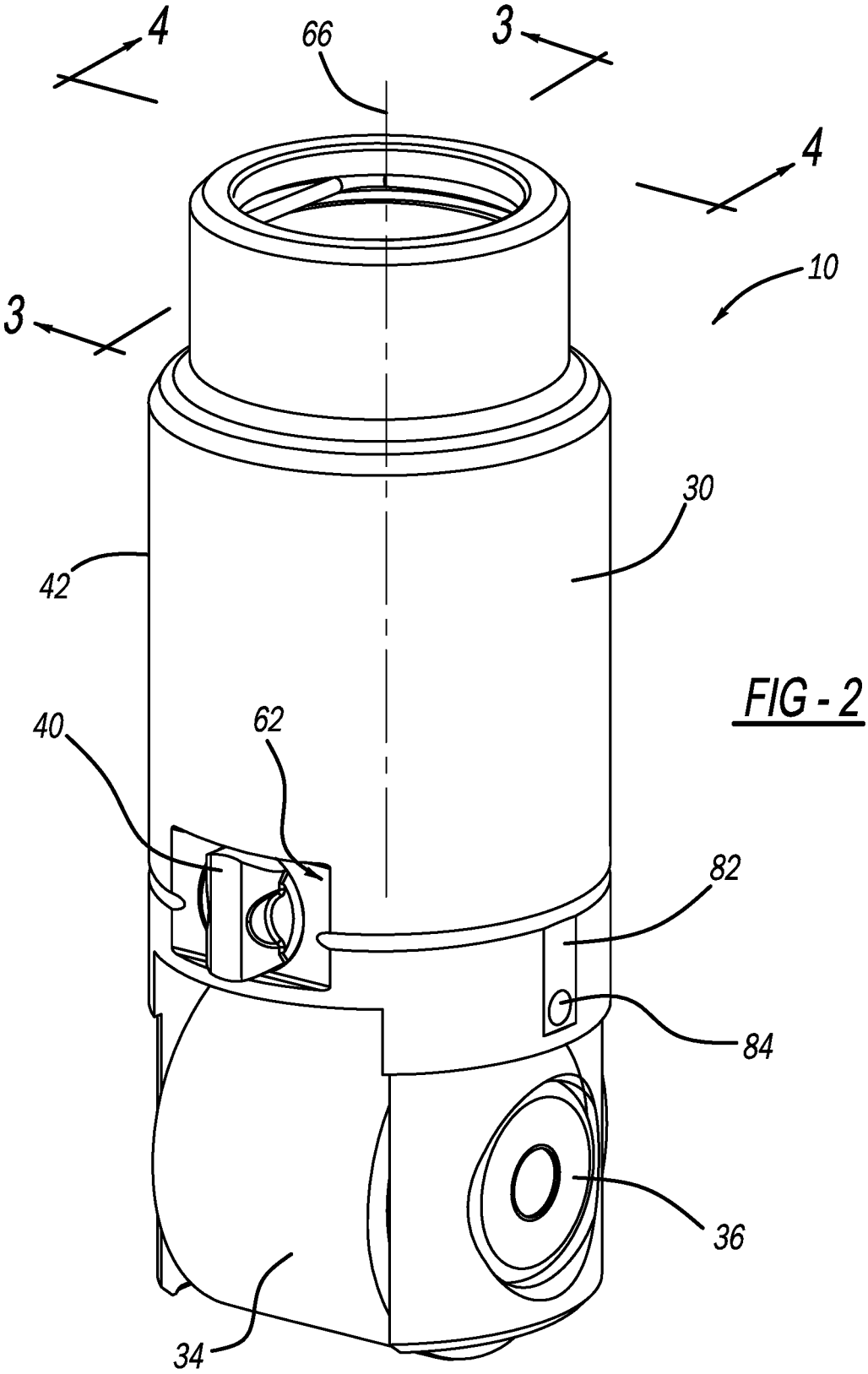
FIG. 2 is a perspective view of a roller lifter and anti-rotation plug of FIG. 1.

With initial reference to FIGS. 1 and 2, a roller lifter constructed in accordance to one example of the present disclosure is shown and generally identified at reference number 10. The roller lifter 10 is shown as part of a Type V arrangement. It will be appreciated that while the roller lifter 10 is shown in a Type V arrangement, the roller lifter 10 may be used in other arrangements within the scope of the present disclosure. In this regard, the features described herein associated with the roller lifter 10 can be suitable to a wide variety of applications. A cam lobe 12 indirectly drives a first end of a rocker arm 14 with a push rod 16. It will be appreciated that in some configurations, such as an overhead cam, the roller lifter 10 may be a direct link between the cam lobe 12 and the rocker arm 14. A second end of the rocker arm 14 actuates a valve 20. As the cam lobe 12 rotates, the rocker arm 14 pivots about a fixed shaft 22. The roller lifter 10 generally includes a body 30, a leakdown assembly 32 received within the body 30, a roller bearing 34 rotatably mounted to the body 30 by an axle 36, and an anti-rotation plug 40. The body 30 includes an outer peripheral surface 42 configured for sliding movement in a bore 44 provided in an engine block or cylinder head 46 of an internal combustion engine 48. In one example the body 30 can be a cold-formed blank made with heat treated steel. The roller bearing 34 can be crowned for engaging the cam 12. In other examples, the profile of the cam 12 can alternatively be crowned.

Figure 3A:
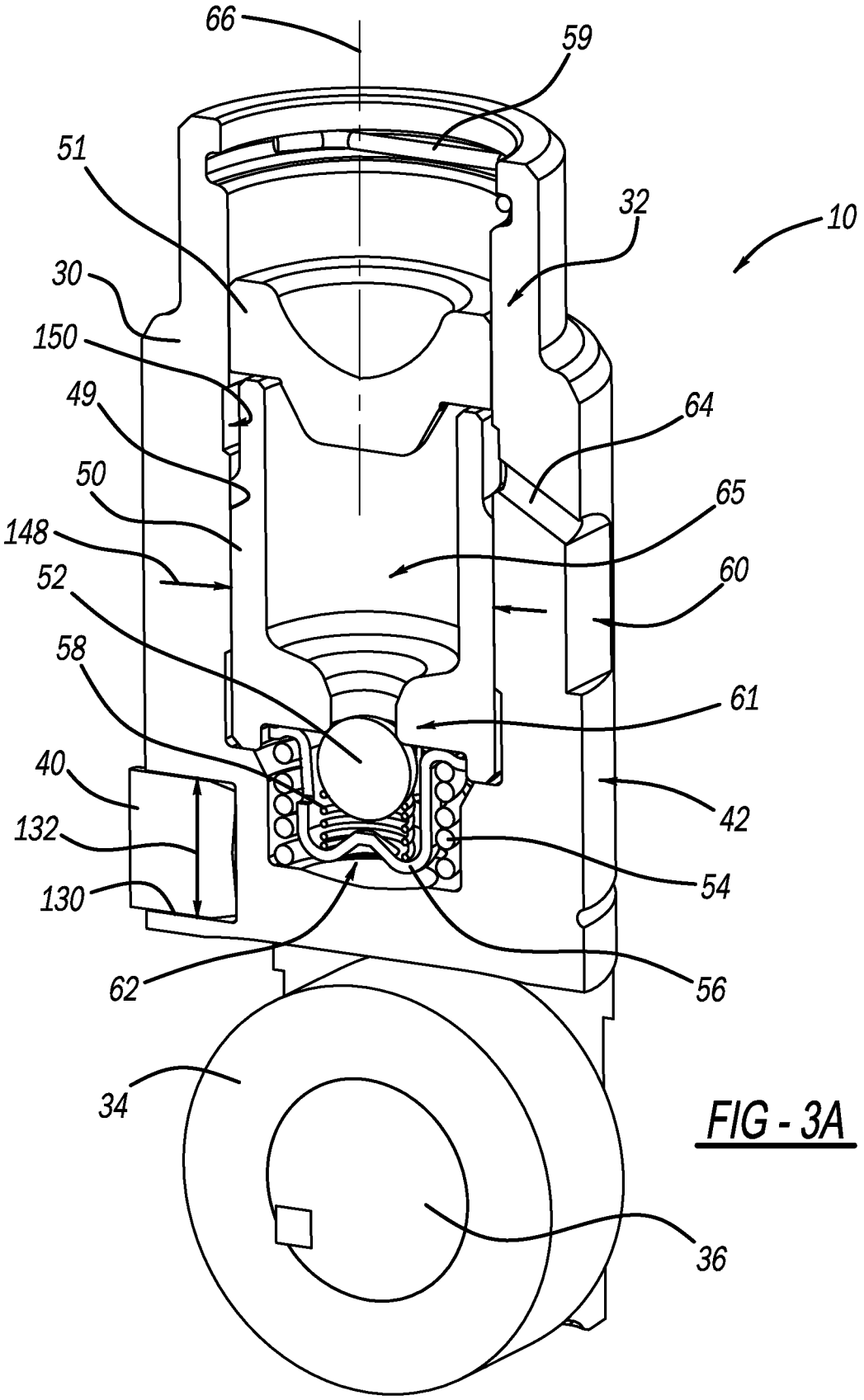
FIG. 3A is a cross-sectional view of the roller lifter taken along lines 3-3 of FIG. 2 and shown with the plunger in a collapsed position.
Figure 3B:
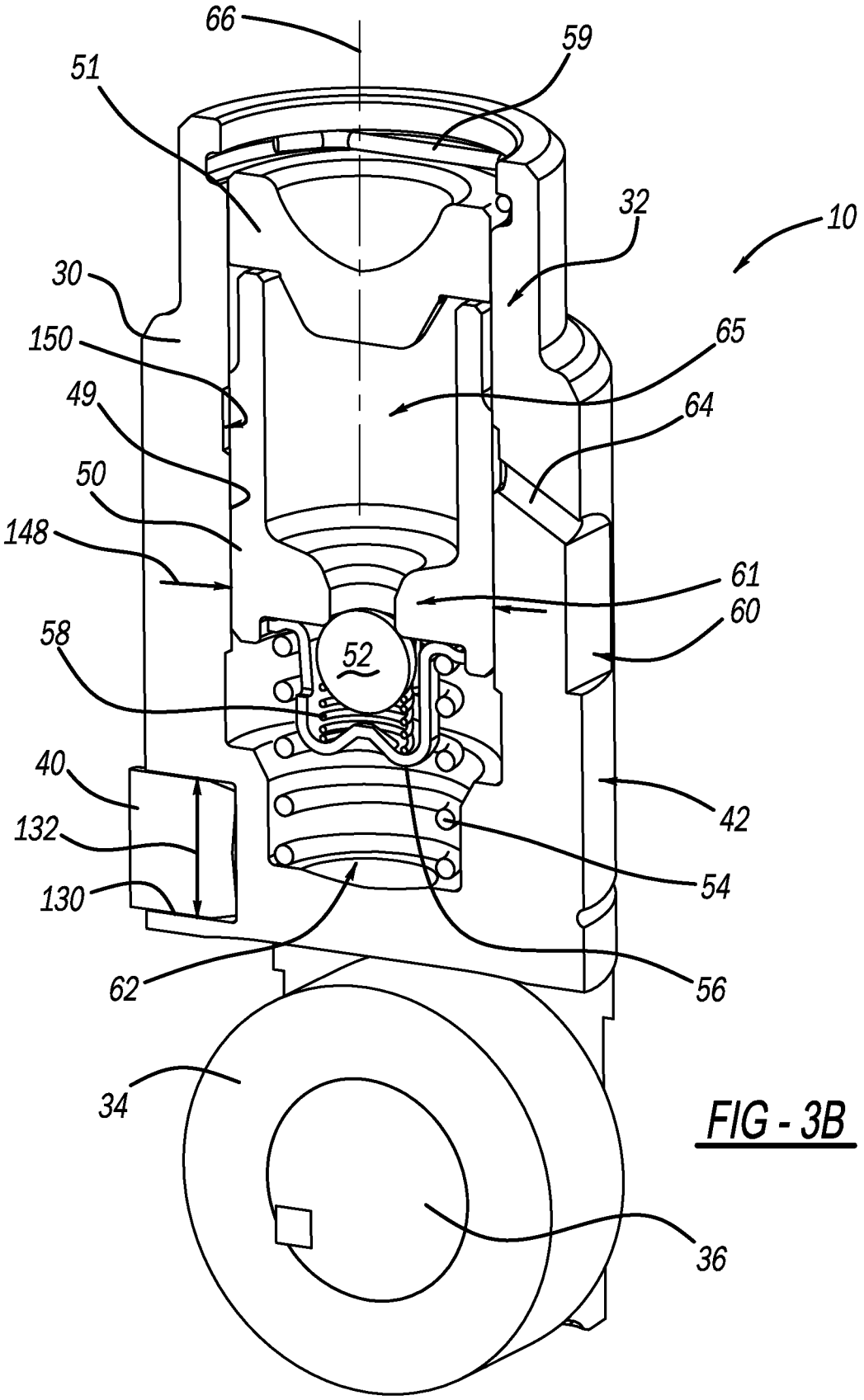
FIG. 3B is a cross-sectional view of the roller lifter taken along lines 3-3 of FIG. 2 and shown with the plunger in an expanded position wherein the socket is urged upward by the first biasing member.

With continued reference to FIG. 1 and additional reference to FIGS. 2 and 3, the body 30 can define an axial pocket 49 that receives the leakdown assembly 32, which can include a plunger 50, a socket 51, a check ball 52, a first biasing member 54, a cage 56, and a second biasing member 58. A ring 59 is positioned in the body 30 to retain the socket 51 and plunger 50. An inset 60 (FIG. 3A) can be provided in the body 30 at the outer peripheral surface 42. The plunger 50, check ball 52, first biasing member 54, cage and second biasing member 58 can collectively define a check valve 61. A relief 62 can be formed such as by machining into the body 30. As will be described in greater detail herein, the relief 62 can account for material deformation that may occur in the body 30 as a result of staking the plug 40. An oil inlet channel 64 can be defined in the body 30 to fluidly connect the inset 60 with the axial pocket 49. The oil inlet channel 64 can be configured to communicate oil between the outer peripheral surface 42 and the plunger 50 of the leakdown assembly 32. The plunger 50 generally defines a reservoir 65.

Figure 4:
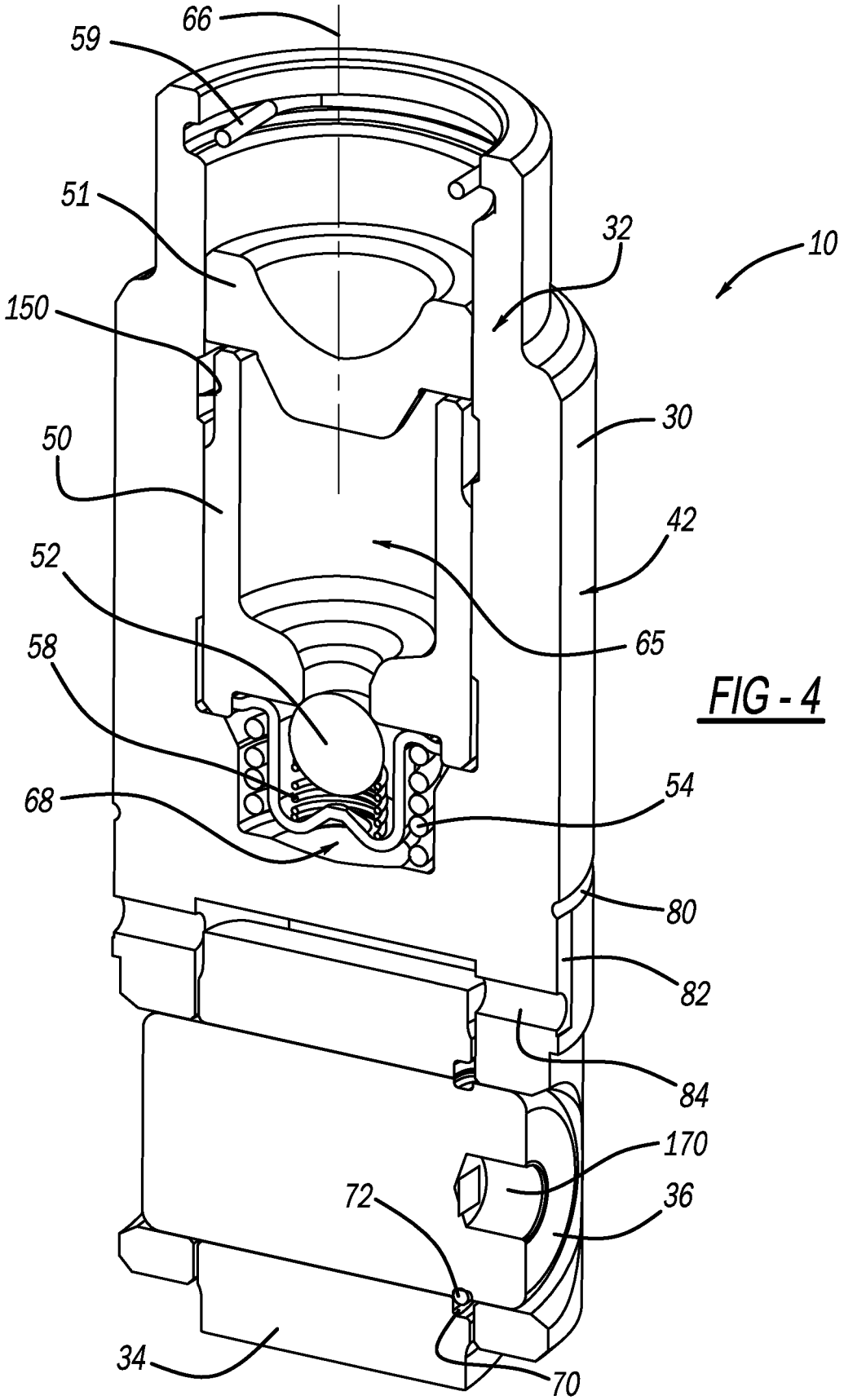
FIG. 4 is a cross-sectional view of the roller lifter taken along lines 4-4 of FIG. 2.

With reference now to FIG. 4, the body 30 extends along a longitudinal axis 66. A high pressure chamber 68 exists in the body 30 generally below the check valve 61 (check ball 52 and plunger 50 interface). A snap ring or clip 70 is nestingly received in a corresponding groove 72 formed on the axle 36 of the roller bearing 34 for capturing the bearing 34 and axle 36 in the roller lifter 10. As identified above, the roller bearing 34 can be configured for rolling contact with the engine camshaft 12. Other configurations are contemplated.

A groove 80 is defined around the body 30 of the roller lifter 10. A connecting channel 82 (FIG. 4) is inset from the outer peripheral surface 42. The connecting channel 82 fluidly connects the groove 80 with a transverse passage 84. During operation, oil received at the groove 80 from an oil gallery communicating with bore 44 of the cylinder head 46 flows around the groove 80, along (down) the connecting channel 82, into the transverse passage 84 and onto the roller bearing 34.

Figure 5:
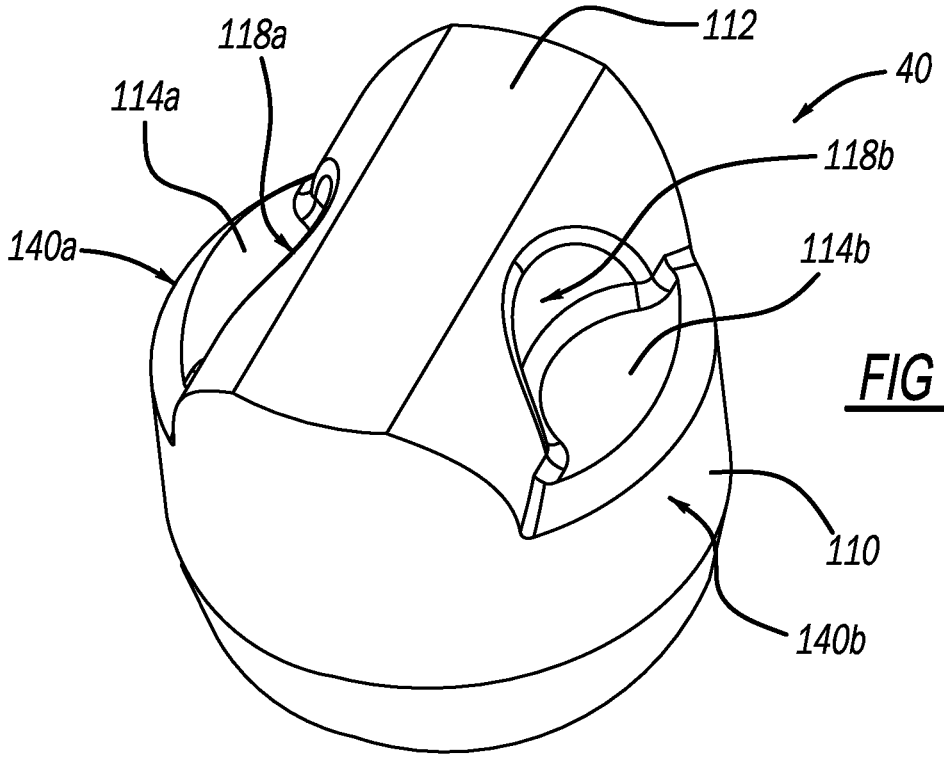
FIG. 5 is a perspective view of the anti-rotation plug of FIG. 1 and constructed according to one example of the present disclosure.

With particular reference to FIG. 5, the anti-rotation plug 40 will be further described. The anti-rotation plug 40 generally includes a plug body 110 having an anti-rotation protrusion 112 extending between first and second face surfaces 114*a*, 114*b*. Radial walls 118*a*, 118*b* are inset into the rotation protrusion 112 and configured to nestingly receive a staking tool. The plug body 110 can be generally cylindrical. The anti-rotation protrusion 112 extends radially beyond the outer peripheral surface 42 of the body 30 in an installed position. Once installed into the body 30 of the roller lifter 10, the anti-rotation plug 40 is configured to locate into a corresponding bore slot 116 (FIG. 1) in the cylinder head 50. The anti-rotation plug 40 keys the body 30 of the roller lifter 10 in the slot for inhibiting rotation of the roller lifter 10 about its longitudinal axis 66 during operation.

Figure 6:
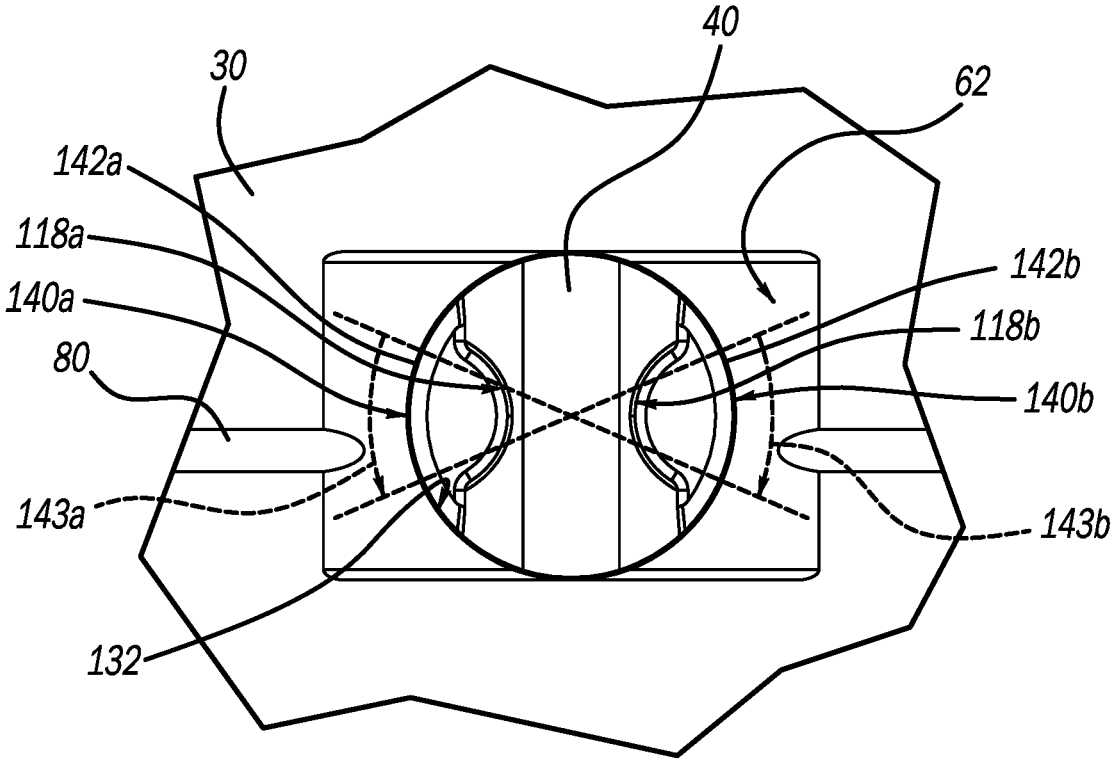
FIG. 6 is a detail view of the anti-rotation plug shown installed into the roller lifter.
Figure 7:
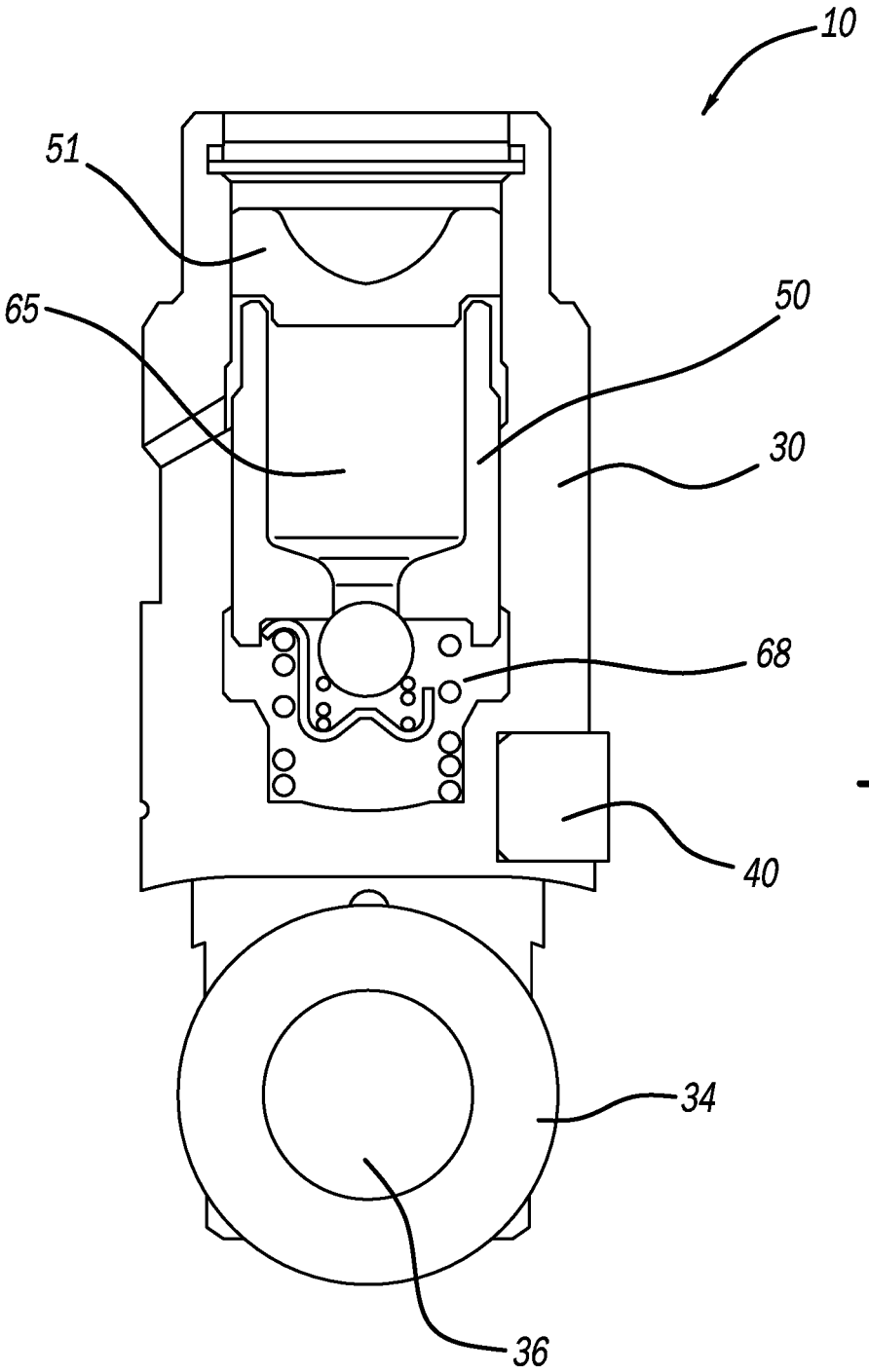
FIG. 7 is a cross-sectional view of the roller lifter shown in FIG. 3A illustrating reserve ratio.
Figures 8A, 8B:
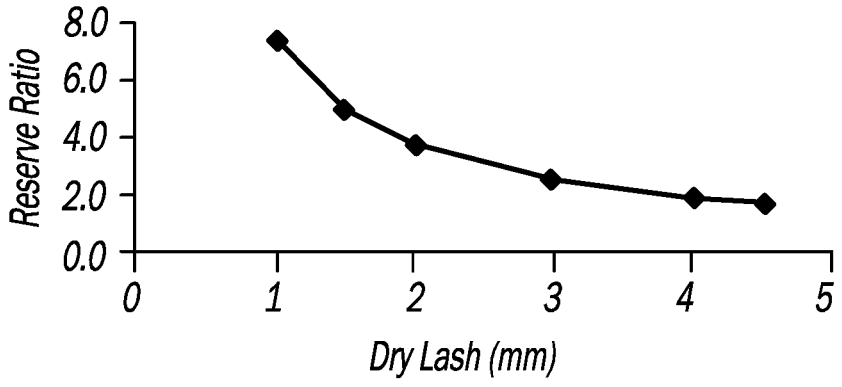
FIG. 8A is a table of Dry Lash versus Reserve Ratio according to one example of the present disclosure.
FIG. 8B is a plot of reserve ration versus dry lash according to one example of the present disclosure.
Figure 9:
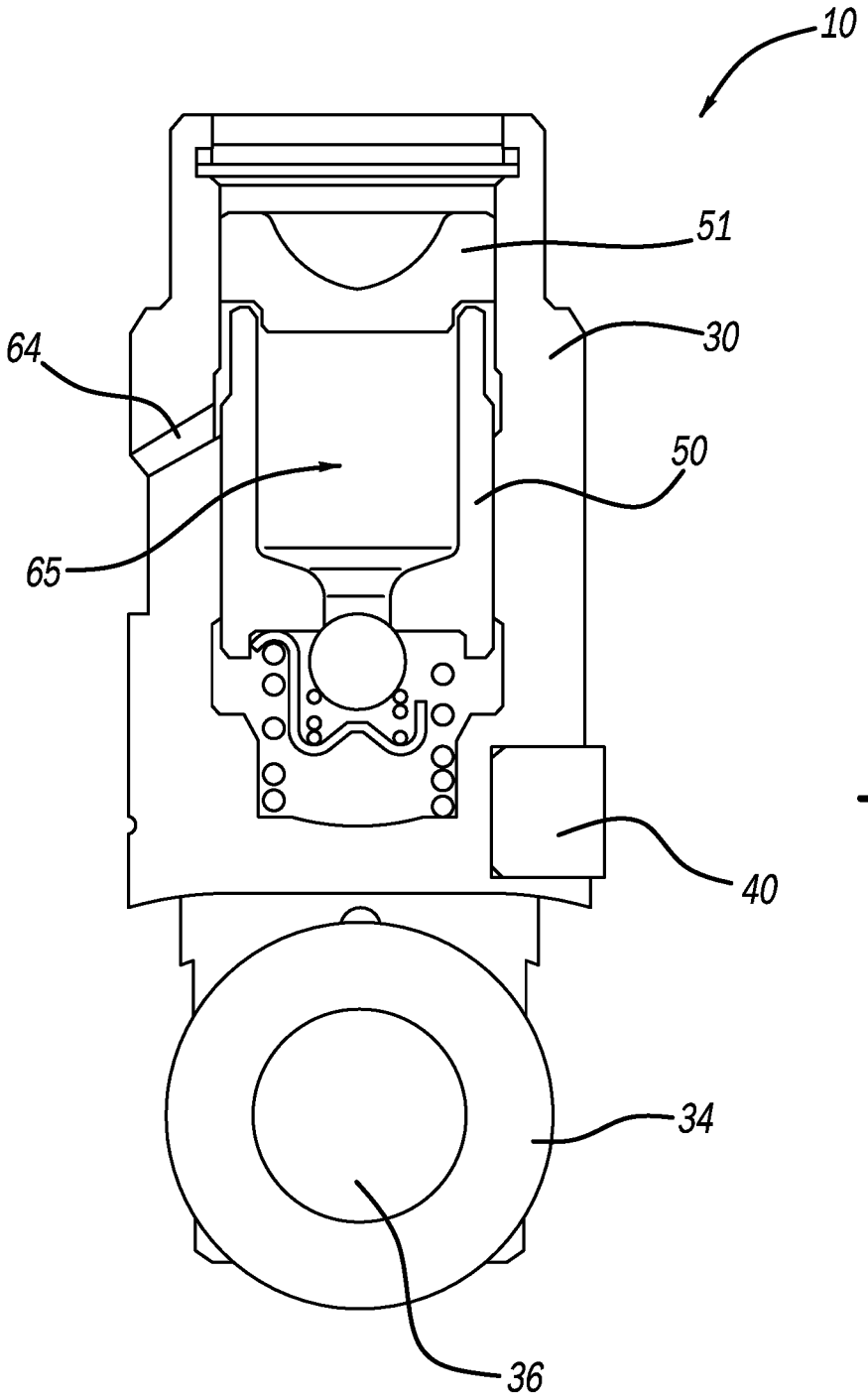
FIG. 9 is a cross-sectional view of the roller lifter of FIG. 7 and shown with the plunger and socket in an operating position.

The anti-rotation plug 40 is configured to be inserted into a corresponding slot or opening 130 (FIG. 3) provided in the body 30 of the roller lifter 10. The opening 130 can define an inner diameter 132. In the example shown in FIG. 6, the outer diameter of the anti-rotation plug 40 and the inner diameter 132 similar such that the anti-rotation plug 40 can be slidably received into the opening 130 of the roller lifter 10. Once the anti-rotation plug 40 is inserted into the opening 130, the anti-rotation plug 40 is staked. By staking, an impact is directed onto the face surfaces 114*a* and 114*b* with a staking tool. The face surfaces 114*a* and 114*b* and the radial walls 118*a*, 118*b* are specifically arranged to receive a staking tool. The staking causes the outer radial surfaces 140*a*, 140*b* expand radially to create an interference fit with the inner diameter 132 of the body 30 at two diametrically opposed patches 142*a*, 142*b*.

The interference fit can be created twice at about thirty degrees (identified at 143*a*, 143*b*) each of the total diameter of the inner diameter 132. In another example, the outer diameter of the plug body is slightly greater than the inner diameter 132 of the body such that a limited interference press fit is achieved by inserting the anti-rotation plug into the opening 130 of the roller lifter 10. During the staking, material from the body 30 can be caused to slightly displace (bulge) at the relief 62. Because the relief 62 is formed inboard relative to the outer peripheral surface 42, any material from the body that may displace can be accommodated at the relief 62 such that no material extends outward from the outer peripheral surface 42. As no material extends outward from the outer peripheral surface 42 due to staking, the body 30 remains cylindrical at the outer surface 42 and any unwanted interference at the bore 44 is avoided.

Figure 10A:
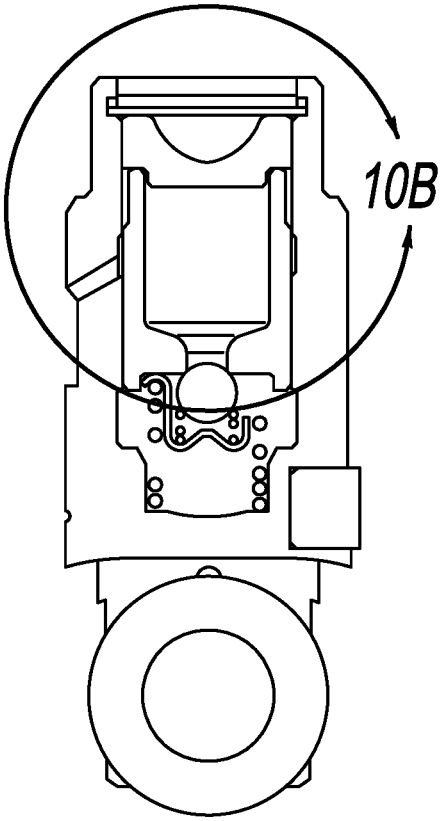
FIG. 10A is a cross sectional view of a roller lifter according to one example of the present disclosure.

Additional features of the roller lifter 10 will now be described. In some examples such as during assembly of the roller lifter 10 into the cylinder head 46 of the internal combustion engine 48, the roller lifter 10 can be in an inverted orientation for significant periods of time (See also FIG. 10). Roller lifters 10 can be installed when the engine block is inverted. The roller lifters 10 can sometimes be inverted for two weeks or more. The roller lifters 10 must not leak oil while inverted during this time. A depleted reservoir can contribute to a noisy lifter.

Prior to assembly into the cylinder head 46, the first biasing member 54 can urge the plunger 50 and socket 51 upward (FIG. 3B) such that the socket 51 engages the ring 59 (see also FIG. 10). When the plunger 50 is in this expanded position, an outer diameter 148 of the plunger 50 is above a supply annulus 150 defined in an inner diameter of the body 30. In this position (FIG. 10), a restriction is provided whereby fluid is precluded from flowing out of the oil inlet channel 64 (FIG. 3B), see also seal position 152, FIG. 10. A tight clearance exists between the plunger 50 and body 30 as well as between the socket 51 and the body 30. The clearance between the body 30 at the interface with the socket is tightly controlled such that fluid is precluded from flowing out of the chamber 65 and around the socket 51. In the particular example shown, the body 30 has an outer diameter of 26 mm. Other dimensions may be used. For example, the body 30 can be between 24 mm and 32 mm.

Figure 10B:
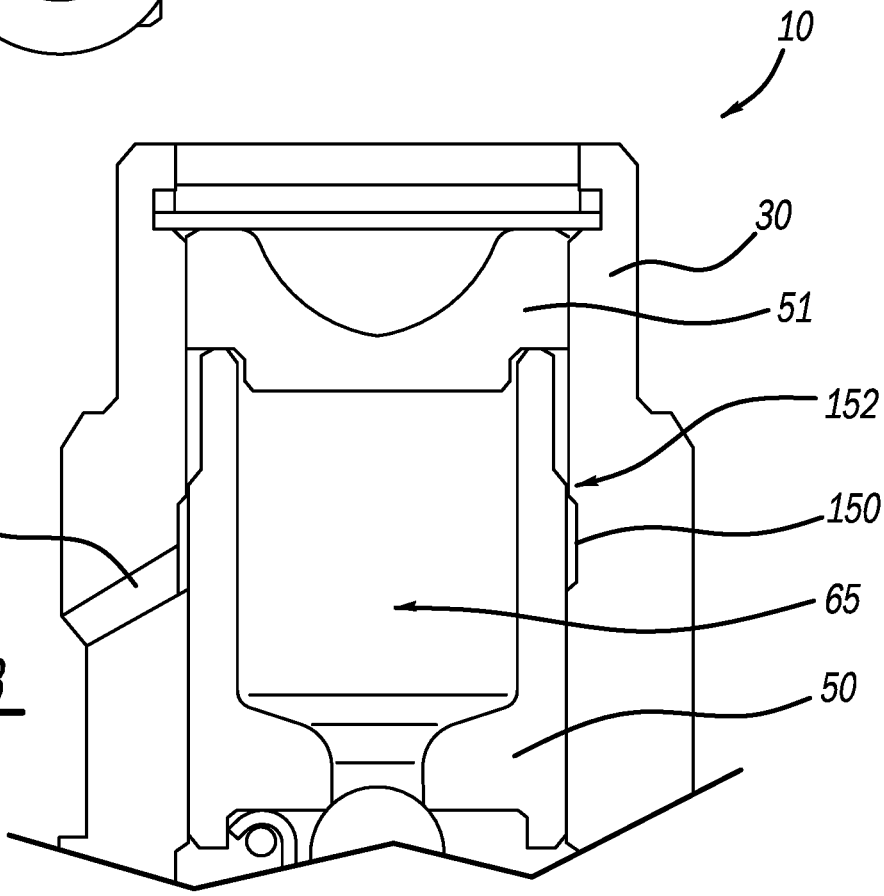
FIG. 10B is a detail view of the roller lifter of FIG. 10A and shown in a pre-assembled (sealed) position.

With reference now to FIGS. 7-10B, a reserve ratio will be further described. A reserve ratio can be defined as the volume of the reservoir 65 over the volume of the high-pressure chamber 68 during stroke. A stroke is defined as the plunger 50 compressed from installed height to a bottomed out position. Upon return to the installed position, fluid from the reservoir 65 will refill the volume in the high pressure chamber 68 that was displaced during compression. As dry lash at the installed height changes, the displaced volume of the high pressure chamber 68 changes during a stroke, which effectively varies the reserve ratio. FIGS. 10A and 10B illustrate a leakdown portion of the roller lifter.

The roller lifter 10 can have a reserve ratio of about 2 to 3 and preferably about 2.5. The reserve ratio can become particularly advantageous in V-type engine block configurations. Explained further, a reserve ratio provided by the roller lifter 10 allows a level of protection as the fluid in the high-pressure chamber 68 can fill the reservoir 65 two and a half times.

While the anti-rotation feature has been described herein as an outwardly extending plug 40 that is received in a corresponding slot 116 defined in the cylinder head 50, these features may be reversed. Explained further, the cylinder head 50 can define an outwardly extending feature that mates with a groove, flat, or other mating feature provided on the body 30 of the roller lifter 10. In another arrangement, opposing features such as flats may be provided on the cylinder head 50 and the roller lifter 10 ensuring that the roller lifter 10 is precluded from rotating within the bore 44. In one example, the relief 62 can extend the longitudinal length (or a portion thereof) of the body 30 for cooperatively opposing a corresponding flat provided on the cylinder head 50.

The axle 36 can have an indent 170 (FIG. 4) formed on one end. The axle 36 can further be diamond-like carbon (DLC) coated. In one advantage, the indent 170 can be used to locate or key the axle 36 into a position conducive for receiving the DLC coating. In one example, the axles 36 are stood up on one end such that the outer diameter surface can be easily viewed and accessed to receive the DLC coating. In another example, the indent 170 can extend the length of the axle 36 whereby a plurality of axles 36 can be strung onto a rod facilitating receipt of the DLC coating. For examples not requiring DLC, the axle 36 can be formed without the indent 170.

Returning now to FIG. 2, the relief 62 can be milled such as with an end mill and/or side milling operation. For example, milling operations can be performed that minimize any sharp edges that may otherwise exist at a transition between the relief 62 and a remainder of the body 30.

Figure 11:
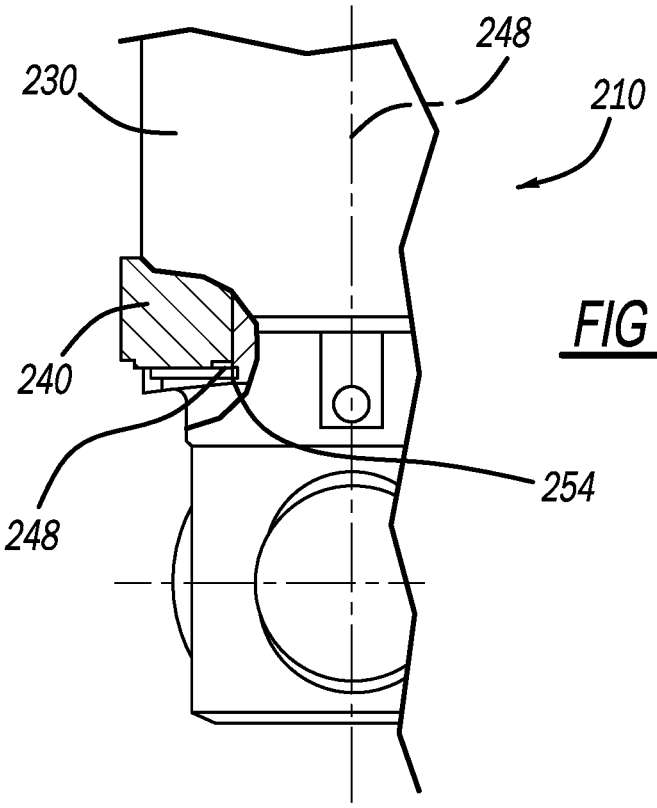
FIG. 11 is a partial side view of a roller lifter constructed in accordance to another example of the present disclosure, the roller lifter having a clip that locks the anti-rotation plug in place.

With reference to FIG. 11, a roller lifter constructed in accordance to another example of the present disclosure is shown and generally identified at reference 210. Unless otherwise described, the roller lifter 210 can be constructed similarly to the roller lifter 10. The roller lifter 210 can have a body 230 that defines an opening 232 that receives an anti-rotation plug 240. The opening 232 can be configured as a slot that receives the anti-rotation plug 240 in a direction upward (in a direction common to a longitudinal axis 248 of the body 230) as viewed in FIG. 11. A clip or snap-ring 254 can be selectively received in a groove 254 defined in one of the body 230 or the plug 232. The snap-ring 254 retains the anti-rotation plug 240 at the opening 232.

Figure 12:
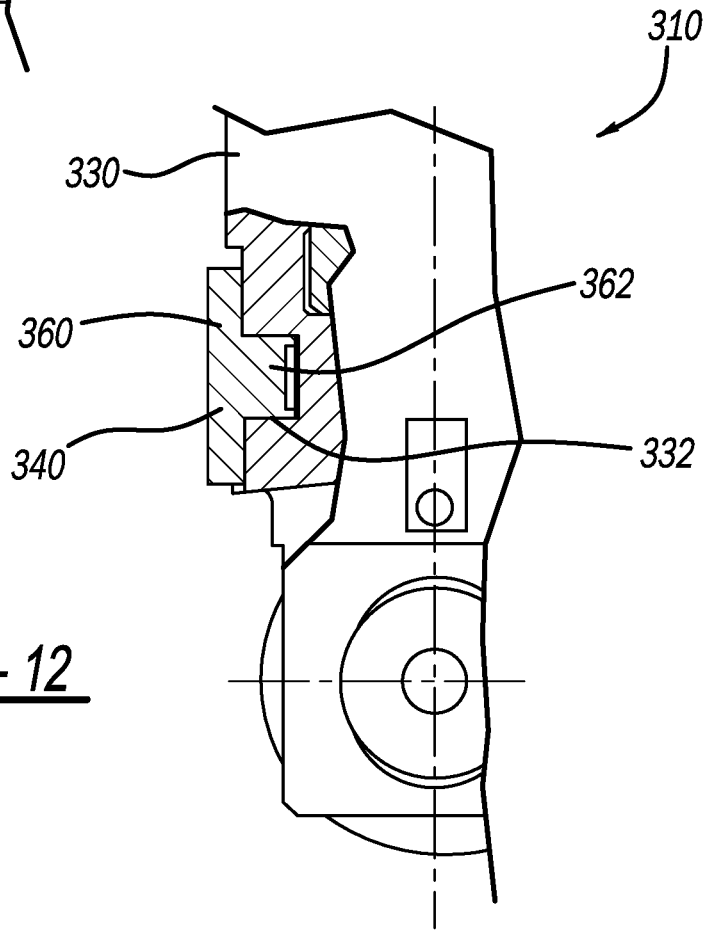
FIG. 12 is a partial side view of a roller lifter constructed in accordance to another example of the present disclosure, the roller lifter having an anti-rotation plug including a reduced diameter post portion.

With reference to FIG. 12, a roller lifter constructed in accordance to another example of the present disclosure is shown and generally identified at reference 310. Unless otherwise described, the roller lifter 310 can be constructed similarly to the roller lifter 10. The roller lifter 310 can have a body 330 that defines an opening 332 that receives an anti-rotation plug 340. The anti-rotation plug 340 has a body portion 360 and a post portion 362. The post portion 362 defines a smaller diameter than the body portion 360. The post portion 362 and/or the body portion 360 can be secured to the body 330 at the opening 332 by a welding operation or flowable adhesive such as Loctite®.

Figure 13:
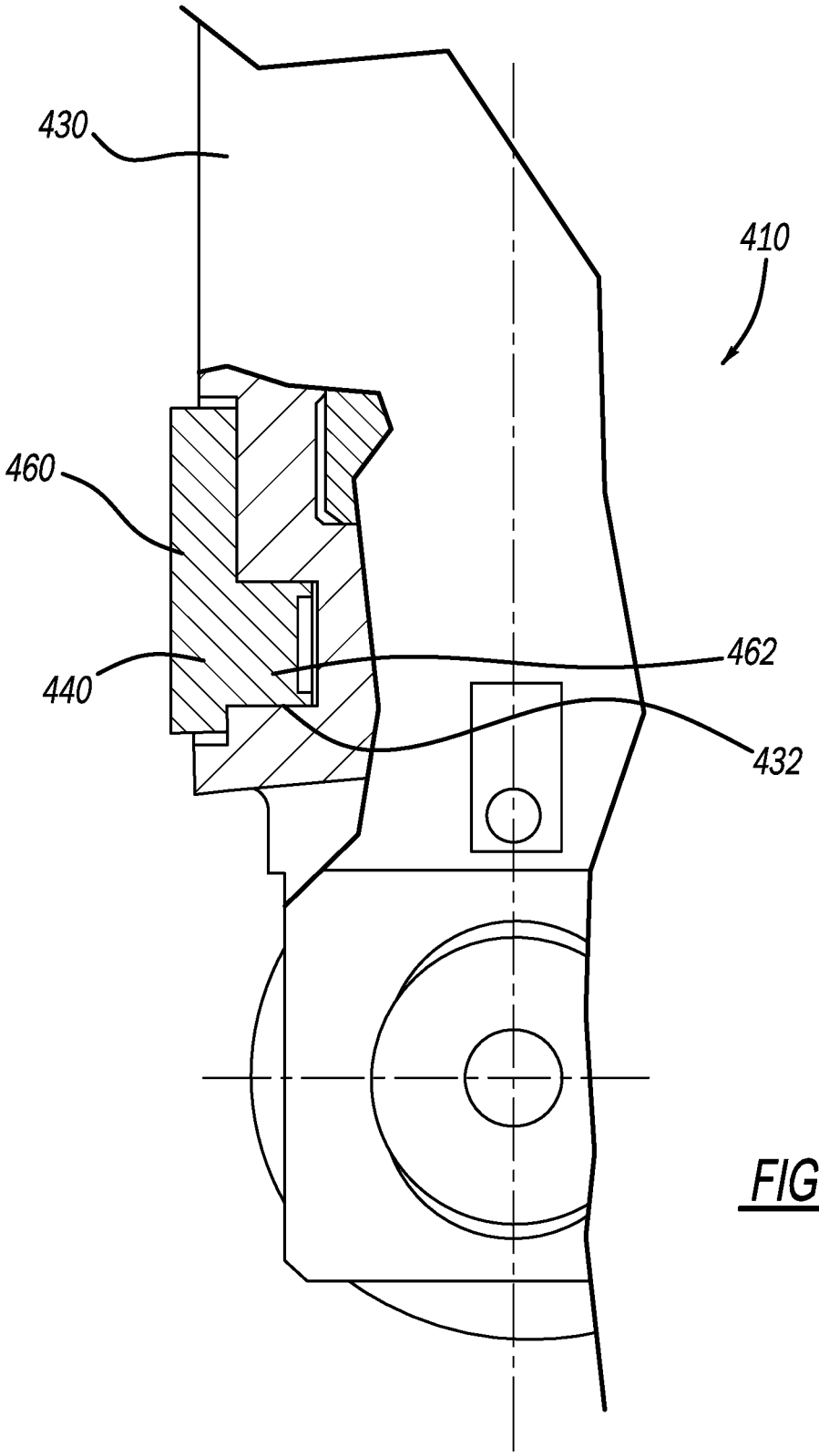
FIG. 13 is a partial side view of a roller lifter constructed in accordance to another example of the present disclosure, the roller lifter having an anti-rotation plug including post portion that is of reduced diameter and offset relative to the main body portion.

With reference to FIG. 13, a roller lifter constructed in accordance to another example of the present disclosure is shown and generally identified at reference 410. Unless otherwise described, the roller lifter 410 can be constructed similarly to the roller lifter 10. The roller lifter 410 can have a body 430 that defines an opening 432 that receives an anti-rotation plug 440. The anti-rotation plug 440 has a body portion 460 and a post portion 462. The post portion 462 is offset relative to the body portion 460. The post portion 462 and/or the body portion 460 can be secured to the body 430 at the opening 432 by a welding operation or flowable adhesive such as Loctite®.

Figure 14A:
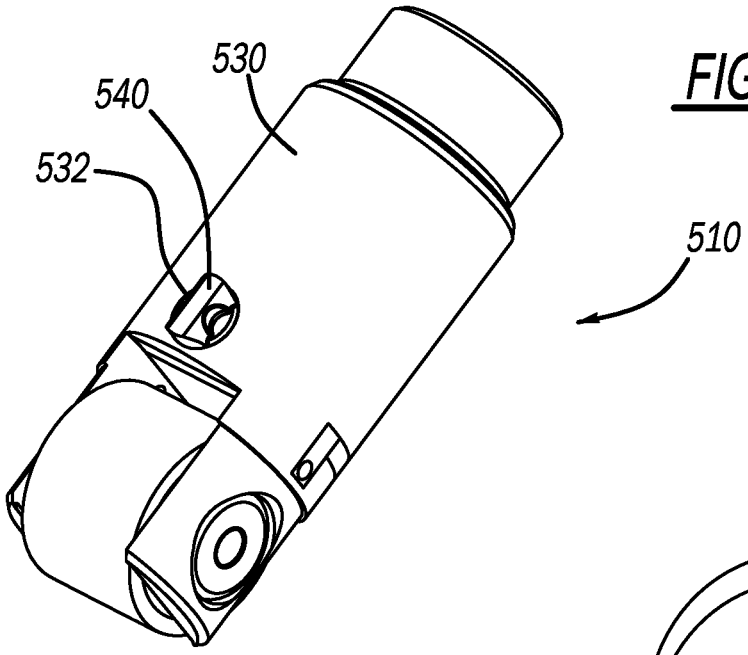
FIG. 14A is a perspective view of a roller lifter constructed in accordance to additional features of the present disclosure and having a roll pin that is inserted into a blind bore, the roll pin mating with a cutout in the anti-rotation plug.
Figure 14B:
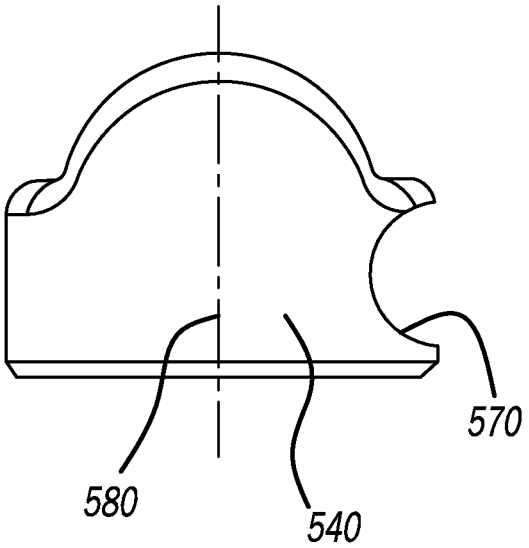
FIG. 14B is a cross sectional profile of the plug of FIG. 14A.
Figure 14C:
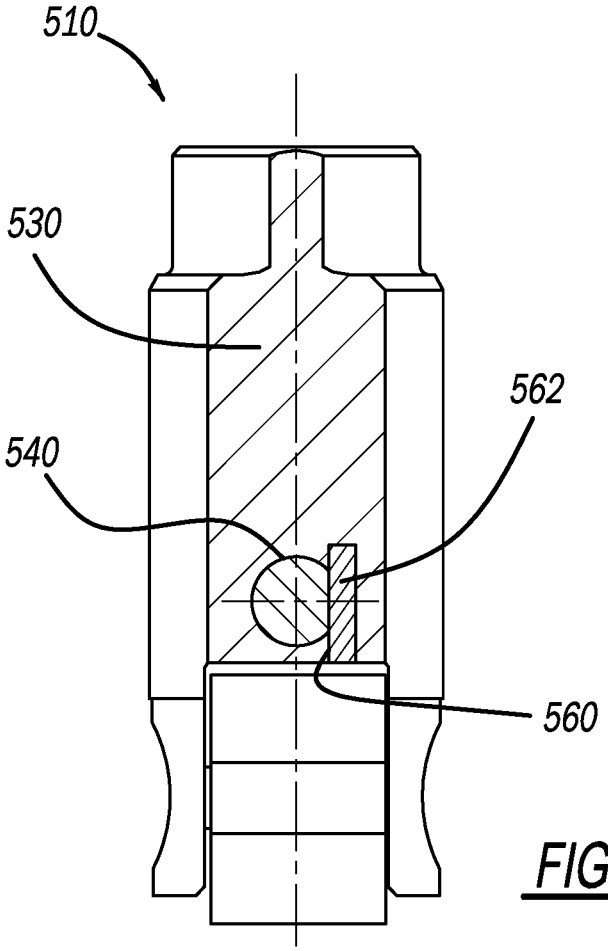
FIG. 14C is a cross-sectional view of the lifter, plug and pin shown in FIG. 14A.
Figure 15A:
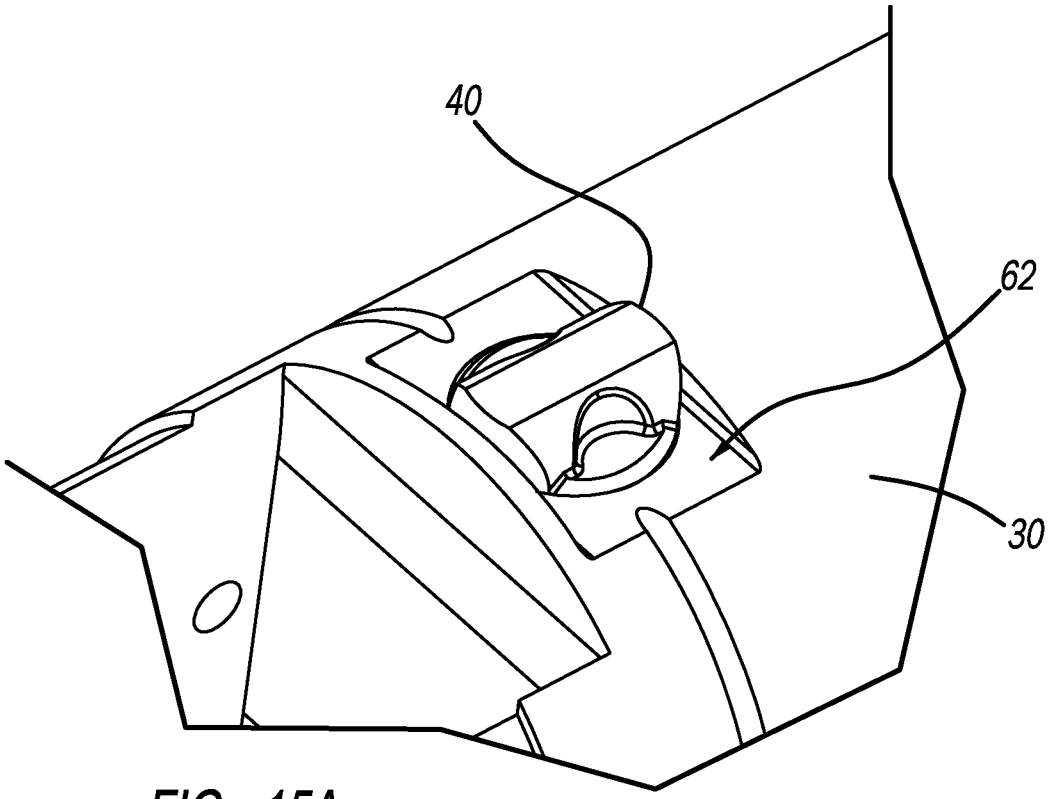
FIG. 15A is a perspective view of a roller lifter constructed in accordance to other features of the present disclosure.
Figure 15B:
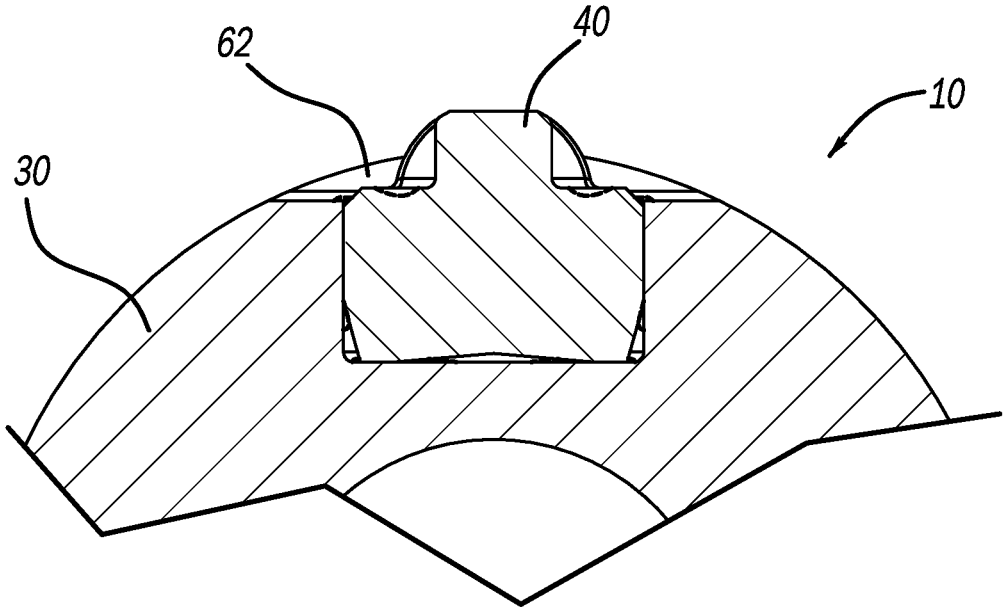
FIG. 15B is a cross-sectional view of the roller lifter of FIG. 15A.

With reference to FIGS. 14A-14C, a roller lifter constructed in accordance to another example of the present disclosure is shown and generally identified at reference 510. Unless otherwise described, the roller lifter 510 can be constructed similarly to the roller lifter 10. The roller lifter 510 can have a body 530 that defines an opening 532 that receives an anti-rotation plug 540. The body 530 can further define a bore 560 that receives a roll pin 562. The roll pin 562 locates at a slot 570 defined in the anti-rotation plug 540. The roll pin 562 precludes rotation of the anti-rotation plug 540 around a plug axis 580.

FIGS. 15-20 illustrate various configurations for managing deformation of the anti-rotation plug during staking. It will be appreciated that some of these configurations may be used alone or in combination with other configurations to accommodate material deformation of the anti-rotation plug as it is staked relative to the body of the roller lifter. It will be appreciated herein that phantom lines have been shown in the drawings to illustrate material deformation after staking. In some examples the plug and/or the body may deform as a result from the staking. FIGS. 15A and 15B show other views of the roller lifter 10 shown in FIG. 2. The relief 62 can account for material deformation that may occur in the body 30 as a result of staking the plug 40. In one non-limiting example, the relief 62 can be 7.585 mm in length and be located at 12.25 mm from a center point of the body 30.

Figure 16:
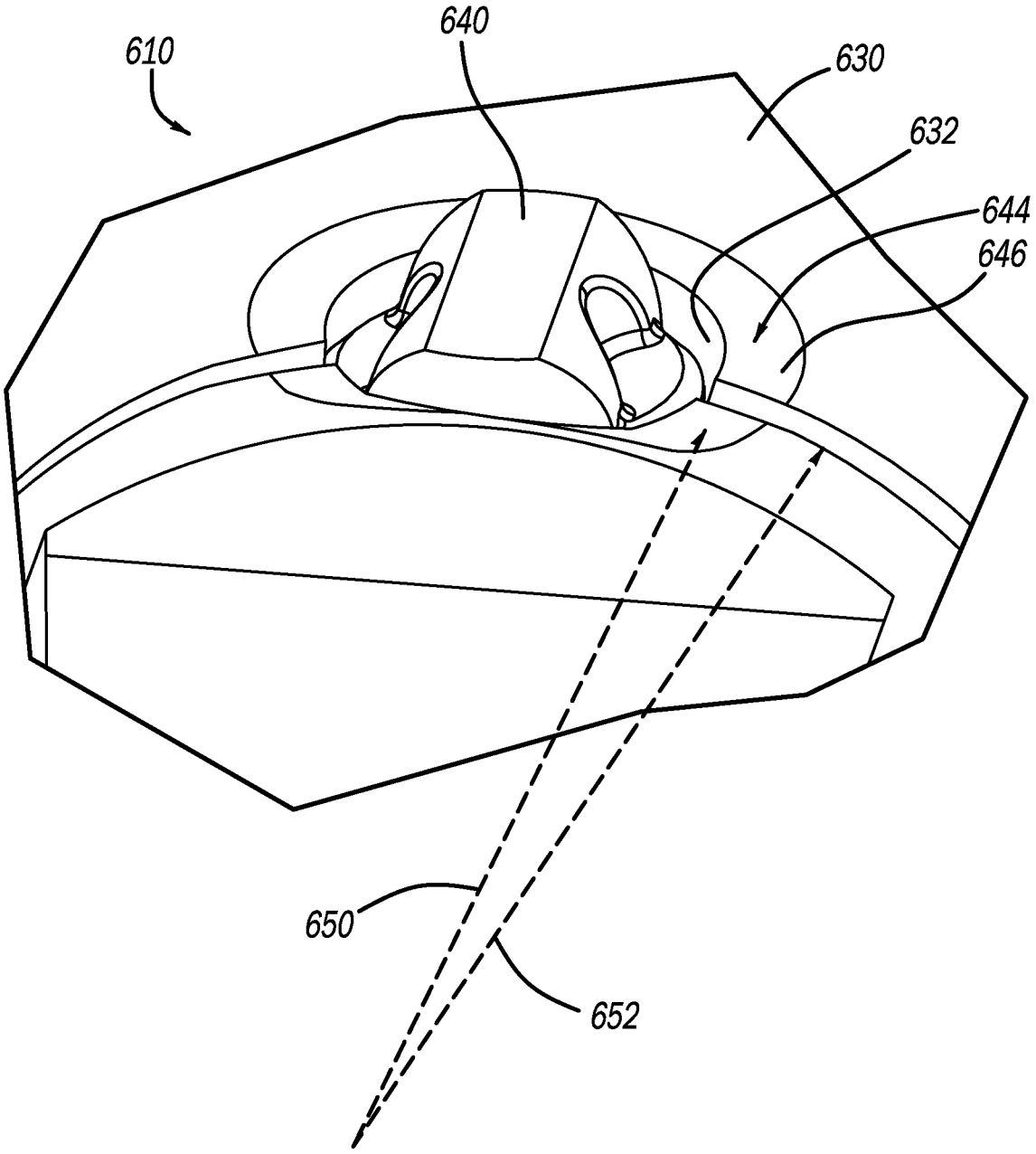
FIG. 16 is a perspective view of a roller lifter constructed in accordance to other features of the present disclosure.

Turning now to FIG. 16, a roller lifter constructed in accordance to another example of the present disclosure is shown and generally identified at reference 610. Unless otherwise described, the roller lifter 610 can be constructed similarly to the roller lifter 10. The roller lifter 610 can have a body 630 that defines an opening 632 that receives an anti-rotation plug 640. A recess 644 is further defined in the body 630 around the opening 632. The recess 644 can define a relief 646 that can account for material deformation of the body 630 during staking of the anti-rotation plug 640 into the opening 632. In general, the recess 644 can define a recess radius 650 that is less than a body radius 652 of the body 630. In one non-limiting example, the recess 644 can have a depth of 50 μm into the body 630 and a width of 1.68 mm from the opening 632. Other dimensions are contemplated. In general, the configuration of the relief 646 is such that the material of the body 630 will not protrude beyond the body radius 652 subsequent to staking.

Figure 17:
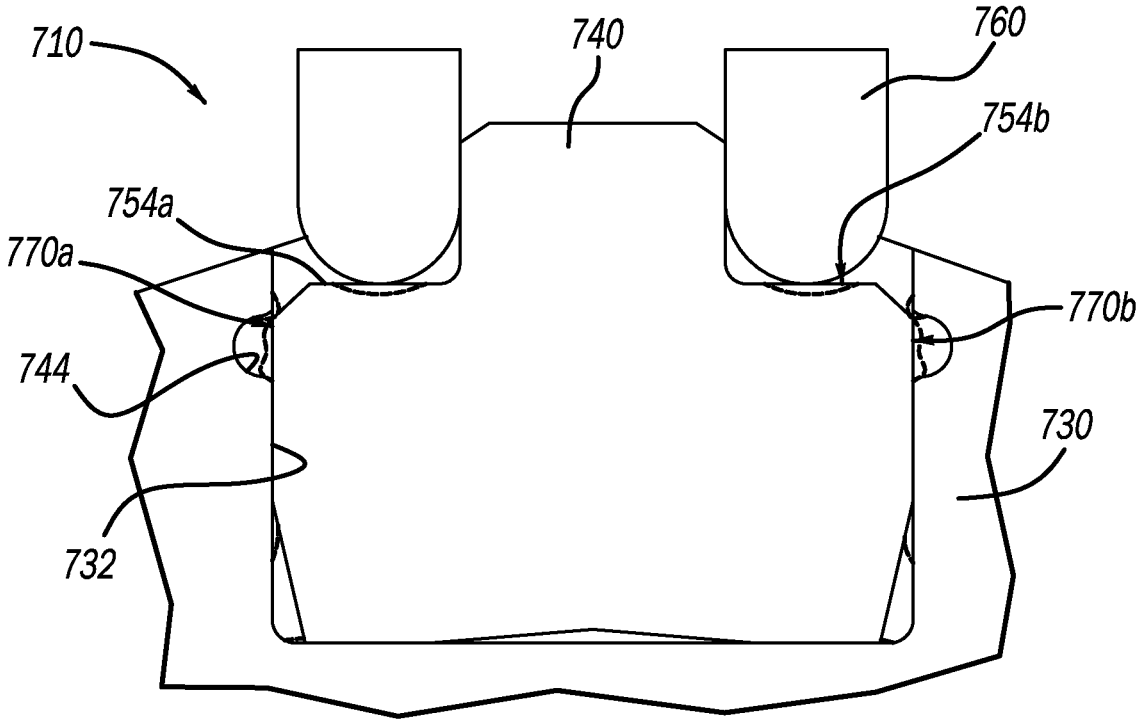
FIG. 17 is a partial cross-sectional view of a roller lifter and anti-rotation plug constructed in accordance to additional features of the present disclosure, the body of the roller lifter having an undercut formed therein, wherein material deformation is shown subsequent to a staking step.

Turning now to FIG. 17, a roller lifter constructed in accordance to additional features of the present disclosure is shown and generally identified at reference 710. Unless otherwise described, the roller lifter 710 can be constructed similarly to the roller lifter 10. The roller lifter 710 can have a body 730 that defines an opening 732 that receives an anti-rotation plug 740. A relief or undercut 744 is further defined in the body 730 from the opening and extending radially outwardly.

Once the anti-rotation plug 740 is inserted into the opening 732, the anti-rotation plug 740 is staked. By staking, an impact is directed onto the face surfaces 754*a* and 754*b* with a staking tool 760. As described above, the staking causes outer radial surfaces 770*a*, 770*b* to expand radially to create an interference fit with the inner diameter 732 of the body 730 at two diametrically opposed patches. The undercut 744 will accommodate material deformation during the staking.

Figure 18:
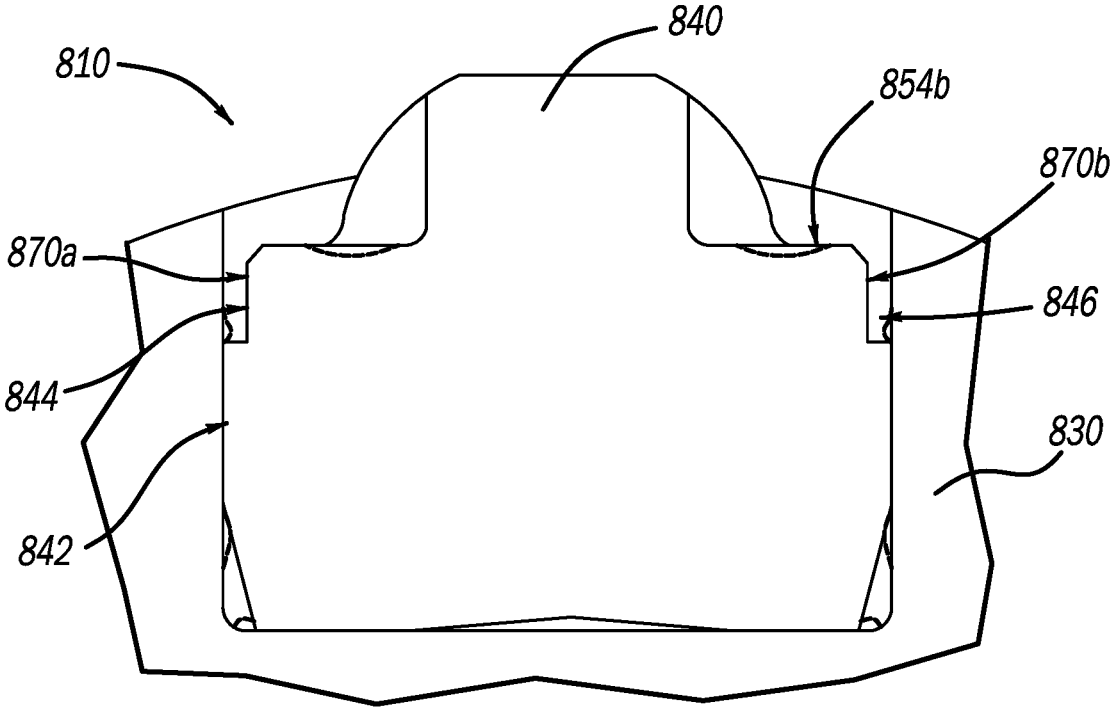
FIG. 18 is a partial cross-sectional view of a roller lifter and anti-rotation plug constructed in accordance to additional features of the present disclosure, the anti-rotation plug having an offset outer diameter portion, wherein material deformation is shown subsequent to a staking step.

Turning now to FIG. 18, a roller lifter constructed in accordance to additional features of the present disclosure is shown and generally identified at reference 810. Unless otherwise described, the roller lifter 810 can be constructed similarly to the roller lifter 10. The roller lifter 810 can have a body 830 that defines an opening 832 that receives an anti-rotation plug 840. The anti-rotation plug 840 can have a first diameter portion 842 and a second diameter portion 844. The second diameter portion 844 is less than the first diameter portion 842 allowing for material deformation of the anti-rotation plug 840 during staking. In other words, an area outboard 846 of the second diameter portion is open prior to staking allowing material to fill or partially fill that area during the staking. In one non-limiting example, the second diameter portion 842 is 0.2 mm less than the first diameter portion. Other configurations are contemplated.

Once the anti-rotation plug 840 is inserted into the opening 832, the anti-rotation plug 840 is staked. By staking, an impact is directed onto the face surfaces 854*a* and 854*b* with a staking tool (see tool 760. FIG. 17). As described above, the staking causes outer radial surfaces 870*a*, 870*b* to expand radially to create an interference fit with the inner diameter 832 of the body 830 at two diametrically opposed patches. The outboard area 846 will accommodate material deformation during the staking.

Figure 19:
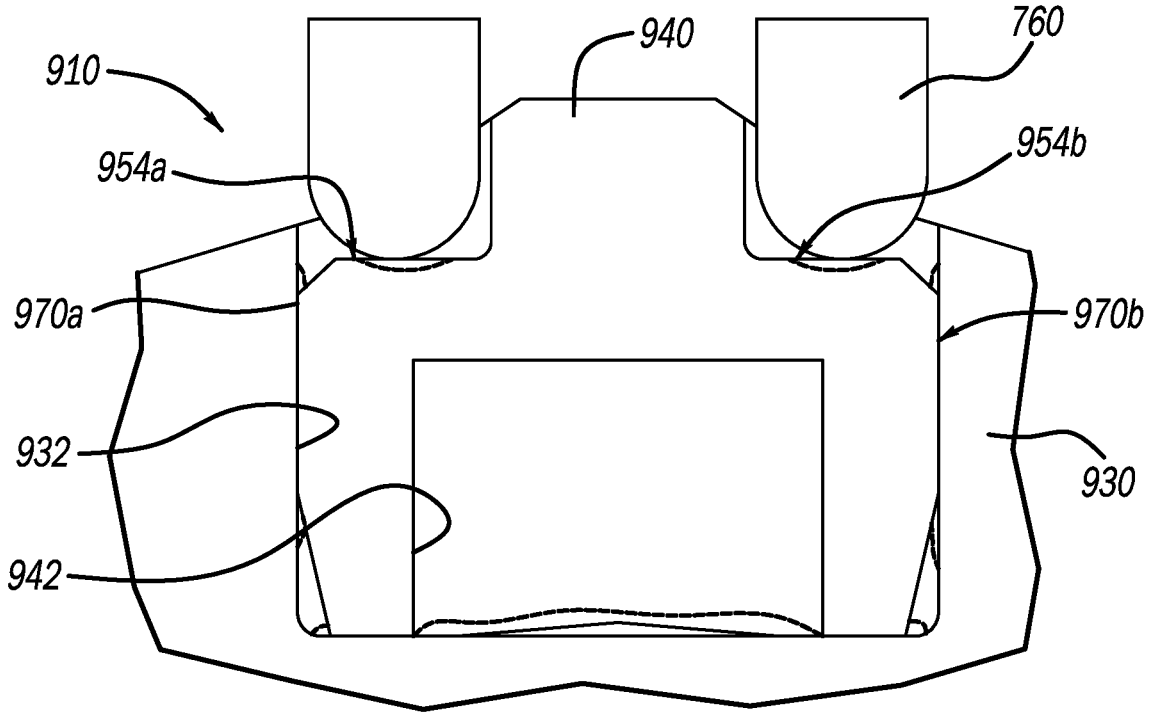
FIG. 19 is a partial cross-sectional view of a roller lifter and anti-rotation plug constructed in accordance to additional features of the present disclosure, the anti-rotation plug having a hollow portion therein, wherein material deformation is shown subsequent to a staking step.

Turning now to FIG. 19, a roller lifter constructed in accordance to additional features of the present disclosure is shown and generally identified at reference 910. Unless otherwise described, the roller lifter 910 can be constructed similarly to the roller lifter 10. The roller lifter 910 can have a body 930 that defines an opening 932 that receives an anti-rotation plug 940. The anti-rotation plug 940 can have a blind bore or hollow portion 942 defined therein. The hollow portion 942 allows for material deformation of the anti-rotation plug 940 during staking. In other words, material of the anti-rotation plug 940 can be deformed inward into the hollow portion 942 during staking.

Once the anti-rotation plug 940 is inserted into the opening 932, the anti-rotation plug 940 is staked. By staking, an impact is directed onto the face surfaces 954*a* and 954*b* with a staking tool 760. As described above, the staking causes outer radial surfaces 970*a*, 970*b* to expand radially to create an interference fit with the inner diameter 932 of the body 930 at two diametrically opposed patches. Additionally, material of the anti-rotation plug 940 can deflect inward into the hollow portion 942 during the staking.

Figure 20:
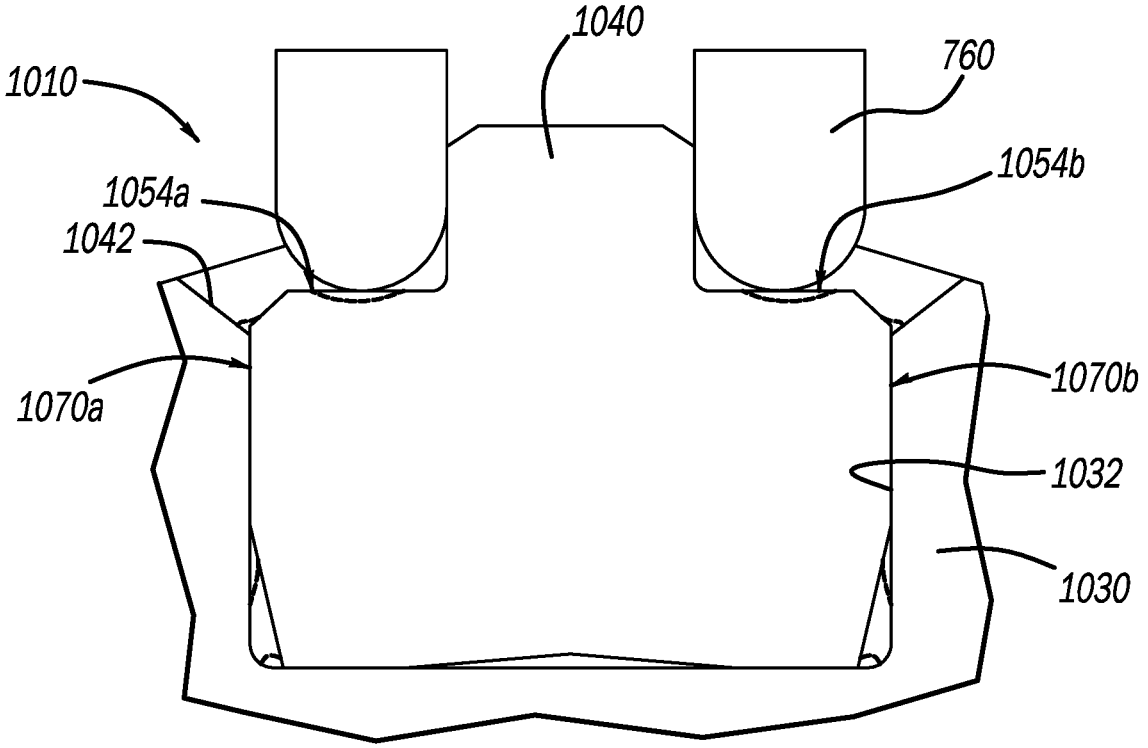
FIG. 20 is a partial cross-sectional view of a roller lifter and anti-rotation plug constructed in accordance to additional features of the present disclosure, the body of the roller lifter having chamfer formed therein, wherein material deformation is shown subsequent to a staking step.

Turning now to FIG. 20, a roller lifter constructed in accordance to additional features of the present disclosure is shown and generally identified at reference 1010. Unless otherwise described, the roller lifter 1010 can be constructed similarly to the roller lifter 10. The roller lifter 1010 can have a body 1030 that defines an opening 1032 that receives an anti-rotation plug 1040. The body 1030 can have a relief or chamfer 1042 defined therein leading into the opening 1032. The chamfer 1042 allows for material deformation of the anti-rotation plug 1040 during staking. In other words, material of the anti-rotation plug 1040 can be deformed into the area defined by the chamfer 1042 during staking.

Once the anti-rotation plug 1040 is inserted into the opening 1032, the anti-rotation plug 1040 is staked. By staking, an impact is directed onto the face surfaces 1054*a* and 1054*b* with a staking tool 760. As described above, the staking causes outer radial surfaces 1070*a*, 1070*b* to expand radially to create an interference fit with the inner diameter 1032 of the body 1030 at two diametrically opposed patches. Additionally, material of the anti-rotation plug 1040 can deflect into the chamfer 1042 during the staking.

The foregoing description of the examples has been provided for purposes of illustration and description. It is not intended to be exhaustive or to limit the disclosure. Individual elements or features of a particular example are generally not limited to that particular example, but, where applicable, are interchangeable and can be used in a selected example, even if not specifically shown or described. The same may also be varied in many ways. Such variations are not to be regarded as a departure from the disclosure, and all such modifications are intended to be included within the scope of the disclosure.

What is claimed is:

1. An engine roller lifter for use in a valvetrain of an internal combustion engine, the engine roller lifter comprising:

a body having an outer peripheral surface configured for sliding movement in a bore provided in the internal combustion engine, the bore supplied oil by an oil passage communicating therewith, the body defining an opening and a relief;

a roller bearing rotatably mounted to the body and configured for rolling contact with an engine camshaft; and an anti-rotation plug received at the opening, the anti-rotation plug having a cylindrical plug body including an anti-rotation protrusion that extends from a face surface of the cylindrical plug body, the anti-rotation plug extending radially beyond an outer peripheral surface of the cylindrical plug body in an installed position, wherein the anti-rotation plug is staked into the opening of the body such that material from the body that is displaced during the staking is accommodated at the relief, wherein outer radial surfaces of the cylindrical plug body expand radially outwardly at diametrically opposed positions subsequent to, and as a result of, the staking causing the cylindrical plug body to attain an interference fit between the cylindrical plug body and an inner diameter of the opening.

2. The engine roller lifter of claim 1 wherein the face surface of the cylindrical plug body further includes first and second face surfaces formed on opposite sides of the anti-rotation protrusion, wherein the anti-rotation plug is staked on at least one of the first and second face surfaces.

3. The engine roller lifter of claim 1 wherein the interference fit is attained at oppositely facing radial surfaces each extending about thirty degrees of the cylindrical plug body.

4. The engine roller lifter of claim 1 wherein the anti-rotation protrusion defines radial walls that are configured to nestingly receive a staking tool.

5. The engine roller lifter of claim 1 wherein the anti-rotation plug is configured to key in a corresponding bore slot defined in an engine block of the internal combustion engine for inhibiting rotation of the engine roller lifter around its axis.

6. The engine roller lifter of claim 1 wherein the relief is further defined by a recess around the opening, the recess defining a recess radius that is less than a body radius defined by the body.

7. The engine roller lifter of claim 1 wherein the relief defines an undercut formed at the opening radially outward, wherein the undercut is configured to accommodate material deformation of the anti-rotation plug during staking.

8. The engine roller lifter of claim 1 wherein the relief defines a chamfer formed at the opening radially outward, wherein the chamfer is configured to accommodate material deformation of the anti-rotation plug during staking.

9. The engine roller lifter of claim 1 wherein the anti-rotation plug has a first diameter portion and a second diameter portion, the second diameter portion being less than the first diameter portion allowing for material deformation of the anti-rotation plug during staking.

10. The engine roller lifter of claim 1 wherein the anti-rotation plug has a hollow portion allowing for material deformation of the anti-rotation plug during staking.

11. An engine roller lifter for use in a valvetrain of an internal combustion engine, the engine roller lifter comprising:

a lifter body having an outer peripheral surface that defines a relief that is inset relative to an outer diameter of the lifter body, wherein the lifter body is configured for sliding movement in a bore provided in the internal combustion engine, the bore supplied oil by an oil passage communicating therewith, the lifter body defining an opening;

a roller bearing rotatably mounted to the lifter body and configured for rolling contact with an engine camshaft; and an anti-rotation plug having a cylindrical plug body that includes first and second face surfaces formed on opposite sides of an anti-rotation protrusion and on a common end of the anti-rotation plug, the anti-rotation plug being staked into the opening by impacting a tool only at the first and second face surfaces, whereby the cylindrical plug body expands radially outwardly at diametrically opposed positions whereby an outer cylindrical surface of the cylindrical plug body attains an interference fit with the opening of the lifter body, wherein material from the lifter body that is displaced during the staking is accommodated at the relief.

12. The engine roller lifter of claim 11 wherein the interference fit is attained at oppositely facing radial surfaces.

13. The engine roller lifter of claim 11 wherein the anti-rotation plug has a hollow portion allowing for material deformation of the anti-rotation plug during staking.

14. The engine roller lifter of claim 11 wherein the anti-rotation plug is configured to key in a corresponding bore slot defined in an engine block of the internal combustion engine for inhibiting rotation of the engine roller lifter around its axis.

15. A method of producing an engine roller lifter for use in a valvetrain of an internal combustion engine, the engine roller lifter having a lifter body having an outer peripheral surface configured for sliding movement in a bore provided in the internal combustion engine, the lifter body defining an opening, the method comprising:

slidably advancing an anti-rotation plug into the opening of the lifter body, the anti-rotation plug having a cylindrical plug body that includes first and second face surfaces formed on opposite sides of an anti-rotation protrusion and on a common end of the anti-rotation plug; and staking the anti-rotation plug by impacting the anti-rotation plug at the first and second face surfaces with a staking tool whereby the cylindrical plug body expands radially outwardly at diametrically opposed positions causing the cylindrical plug body to attain an interference fit between the cylindrical plug body and the opening of the lifter body.

16. The method of claim 15 wherein the staking comprises:

impacting at least one of the first and second face surfaces of the anti-rotation plug; and displacing material of the lifter body into at least one relief portion defined in the lifter body resulting from the impacting.

17. The method of claim 15 wherein the cylindrical plug body expands radially outwardly at oppositely facing radial surfaces.

* * * * *